US012123286B2

(12) United States Patent
Dyess et al.

(10) Patent No.: US 12,123,286 B2
(45) Date of Patent: Oct. 22, 2024

(54) SELF-ARMING PERFORATING SYSTEM AND METHOD

(71) Applicant: Hunting Titan, Inc., Pampa, TX (US)

(72) Inventors: Adam Dyess, Houston, TX (US); Julio Cesar Veliz, Cypress, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/474,093

(22) Filed: Sep. 25, 2023

(65) Prior Publication Data

US 2024/0175338 A1 May 30, 2024

Related U.S. Application Data

(63) Continuation of application No. PCT/US2023/072124, filed on Aug. 11, 2023.

(60) Provisional application No. 63/385,625, filed on Nov. 30, 2022.

(51) Int. Cl.
*E21B 43/117* (2006.01)
*E21B 43/116* (2006.01)
*E21B 43/1185* (2006.01)

(52) U.S. Cl.
CPC ..... *E21B 43/117* (2013.01); *E21B 43/116* (2013.01); *E21B 43/1185* (2013.01)

(58) Field of Classification Search
CPC ... E21B 43/116; E21B 43/117; E21B 43/1185
See application file for complete search history.

(56) References Cited

U.S. PATENT DOCUMENTS

| | | | |
|---|---|---|---|
| 4,172,421 | A | 10/1979 | Regalbuto |
| 4,561,356 | A | 12/1985 | Bordon |
| 5,027,708 | A | 7/1991 | Gonzalez et al. |
| 10,077,641 | B2 | 9/2018 | Rogman et al. |
| 10,584,950 | B2 | 3/2020 | Saltarelli et al. |
| 10,876,381 | B2 | 12/2020 | Walters et al. |
| 2021/0222525 | A1* | 7/2021 | Dyess ..... F42B 3/103 |
| 2022/0010660 | A1 | 1/2022 | Dyess et al. |

FOREIGN PATENT DOCUMENTS

WO 2022164924 A1 8/2022

OTHER PUBLICATIONS

PCT/US2023/072124 International Search Report, Nov. 6, 2023, 2 pages.
PCT/US2023/072124 Search Strategy, Oct. 4, 2023, 5 pages.
PCT/US2023/072124 Written Opinion of the International Searching Authority, Nov. 6, 2023, 6 pages.

* cited by examiner

*Primary Examiner* — Yong-Suk (Philip) Ro

(57) ABSTRACT

A method and apparatus for a perforating gun having a movable detonator holder in a first perforating gun that is positioned inside the carrier such that the detonator is not directly positioned end to end nor side by side with the detonating cord in the loading tube. When a second perforating gun is screwed onto the first perforating gun, the entire charge tube assembly moves, closing the detonator holder further into the carrier such that the detonating holder closes in on the detonating cord until the detonator is adjacent to the detonating cord to connect the detonator to detonating cord ballistic train.

18 Claims, 6 Drawing Sheets

SECTION B-B

SECTION C-C

SELF-ARMING PERFORATING SYSTEM AND METHOD

RELATED APPLICATIONS

This application is a bypass continuation of PCT/US23/72124, filed on Aug. 11, 2023, which claims priority to U.S. Provisional Application No. 63/385,625, filed Nov. 30, 2022.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by a detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the case of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable, because the gun assembler must make wire connections which is prone to human error. The initiating cartridge option is less desirable because the cartridge can be a large explosive device—in comparison to a standard detonator—thus takes up additional magazine space at the user facility.

Conventional perforating in vertical wells or unconventional perforating in horizontal wells conveyed by electrical line during which one or more of the perforating guns in the downhole tool string are oriented by either one or more of the following orientating methods: motorized orientation tool, eccentric weight bars and self-orienting charge tube assemblies.

Oriented perforating is a completion method used to connect to the reservoir formation in a specific transverse plane or to avoid perforating other wellbore tubulars and data lines, such as fiber optic cable, attached to the inside or outside of the casing which is being perforated.

SUMMARY OF EXAMPLE EMBODIMENTS

An example embodiment may include a perforating gun comprising an outer carrier, a charge tube assembly that having a loading tube containing a plurality of shaped charges and a detonating cord coupled to said shaped charges, a loading tube end fitting coupled to a first end of the loading tube containing a detonator housed in a hinged detonator holder configured to move the detonator between a ballistically unarmed position to a ballistically armed position.

A variation of the example embodiment may include the ballistically unarmed detonator is the detonator not directly positioned end to end nor side by side with the detonating cord in the loading tube. The ballistically armed detonator may be the detonator directly positioned end to end or side by side with the detonating cord in the loading tube. The detonator holder may be a hinged door with a wedge shaped outer profile configured to shut as the outer profile makes contact with the inner surface of the carrier when the charge tube assembly moves further into the carrier. The charge tube assembly may be moved as a result of the perforating gun being coupled to a second perforating gun. The detonator holder may be a hinged door with a curved shaped outer profile configured to shut as the outer profile makes contact with the inner surface of the carrier when the charge tube assembly moves further into the carrier. The detonator holder may be a sliding door configured to slide as the outer profile makes contact with the inner surface of the carrier when the charge tube assembly moves further into the carrier. In its initial state prior to connecting the second perforating gun, the movable detonator holder of the first perforating gun may be positioned inside the carrier such that the detonator is not directly positioned end to end nor side by side with the detonating cord in the loading tube. The second perforating gun may be screwed onto the first perforating gun, the entire charge tube assembly moves, closing the detonator holder further into the carrier such that the detonating holder closes in on the detonating cord until the detonator is adjacent to the detonating cord to connect the detonator to detonating cord ballistic train. The second perforating gun may be screwed onto the first perforating gun, the detonator holder moves in relation to the loading tube inside the carrier such that the detonating holder closes in on the detonating cord until the detonator is adjacent to the detonating cord to connect the detonator to detonating cord ballistic train. The second perforating gun may be screwed onto the first perforating gun, the detonator holder slides a further distance than does the entire charge tube assembly and positions the detonator adjacent to the detonating cord to connect the detonator to detonating cord ballistic train.

An example embodiment may include a method for perforating a wellbore comprising coupling a loading tube, a plurality of shaped charges, and a detonating cord into a first perforating gun assembly, inserting a detonator into a movable detonator holder in a loading tube end fitting, and coupling the loading tube end fitting, wherein the movable detonator holder is inserted into the first perforating gun, moving the detonator between a ballistically unarmed position to a ballistically armed position.

A variation of the example embodiment may include the ballistically unarmed detonator being the detonator not directly positioned end to end nor side by side with the detonating cord in the loading tube. The ballistically armed detonator may be a detonator directly positioned end to end or side by side with the detonating cord in the loading tube. It may include moving the charge tube assembly by coupling a second perforating gun into the first perforating gun. It may include sliding the detonator holder as the outer profile makes contact with the inner surface of the carrier when the charge tube assembly moves further into the carrier. Its initial state prior to connecting the second perforating gun, the movable detonator holder of the first perforating gun may be positioned inside the carrier such that the detonator is not directly positioned end to end nor side by side with the detonating cord in the loading tube. The second perforating gun may be screwed onto the first perforating gun, the entire charge tube assembly moves, closing the detonator holder further into the carrier such that the detonating holder closes in on the detonating cord until the detonator is adjacent to the detonating cord to connect the detonator to detonating cord ballistic train. The second perforating gun may be screwed onto the first perforating gun, the detonator holder moves in relation to the loading tube inside the carrier such that the detonating holder closes in on the detonating cord until the detonator is adjacent to the detonating cord to connect the detonator to detonating cord ballistic train. The second perforating gun may be screwed onto the first perforating gun, the detonator holder slides a further distance than does the entire charge tube assembly and positions the detonator adjacent to the detonating cord to connect the detonator to detonating cord ballistic train.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several figures of the drawing. Briefly.

DETAILED DESCRIPTION OF THE EXAMPLE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular initiator assembly disclosed herein.

Traditional methods to orient perforating guns in a horizontal well involve installing eccentric weight bars above, below or above and below the perforating guns so that the entire gun tool string will rotate due to gravity such that the weighted side of the eccentric weight bars are on the low side of the horizontal well. The guns in a traditional oriented perforating string can be locked into a desired shot position, in relation to the weighted side of the eccentric weights, utilizing lock collar tandems between each gun. These traditional orienting methods can be inaccurate (+/−30 degrees) due to well casing conditions and involve adding lengthy eccentric weight bars and lock collar tandems to the string.

Figure 1:
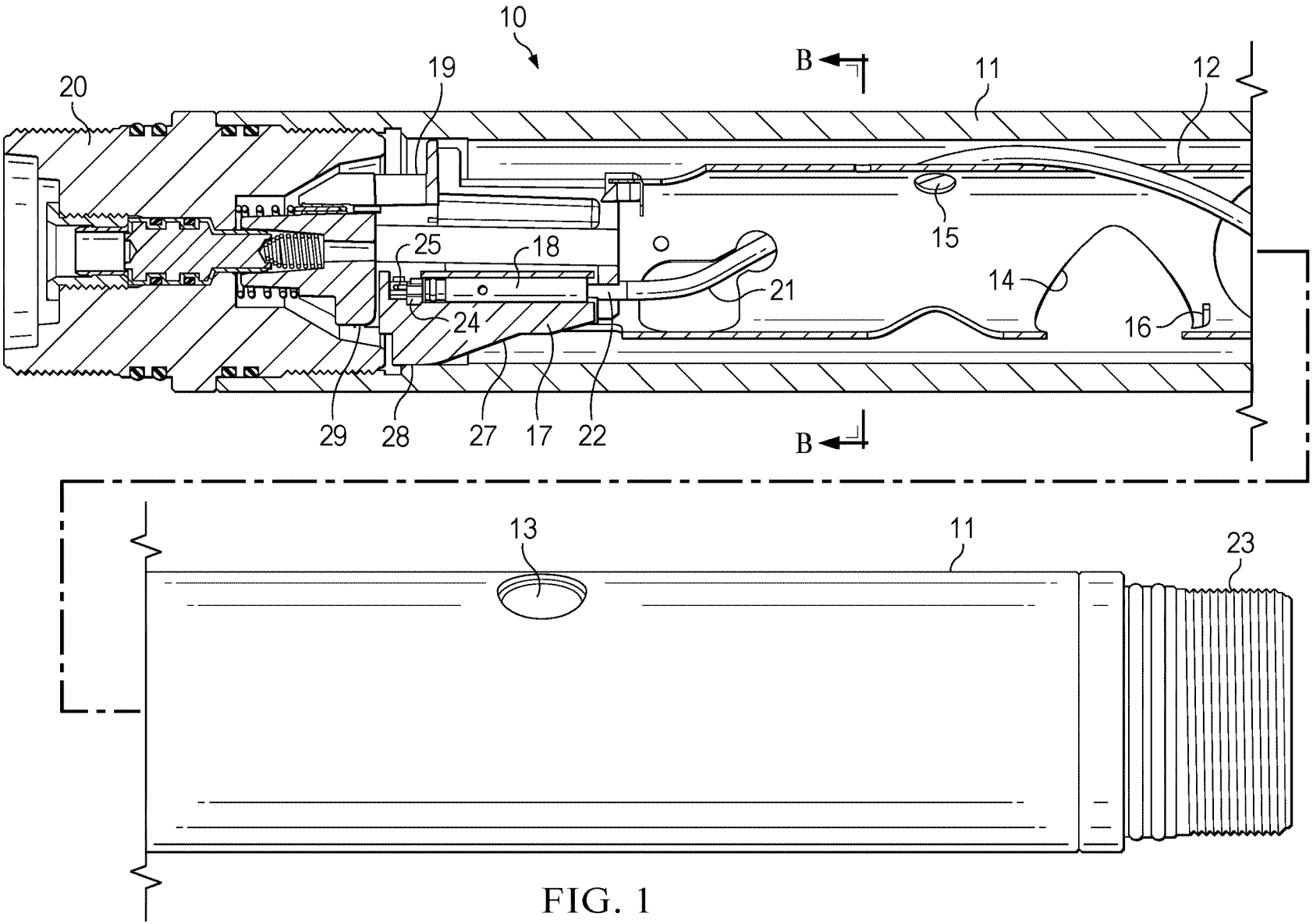
FIG. 1 shows a side cross-section view of an example embodiment of an assembled perforating gun containing a self-arming device.
Figure 2:
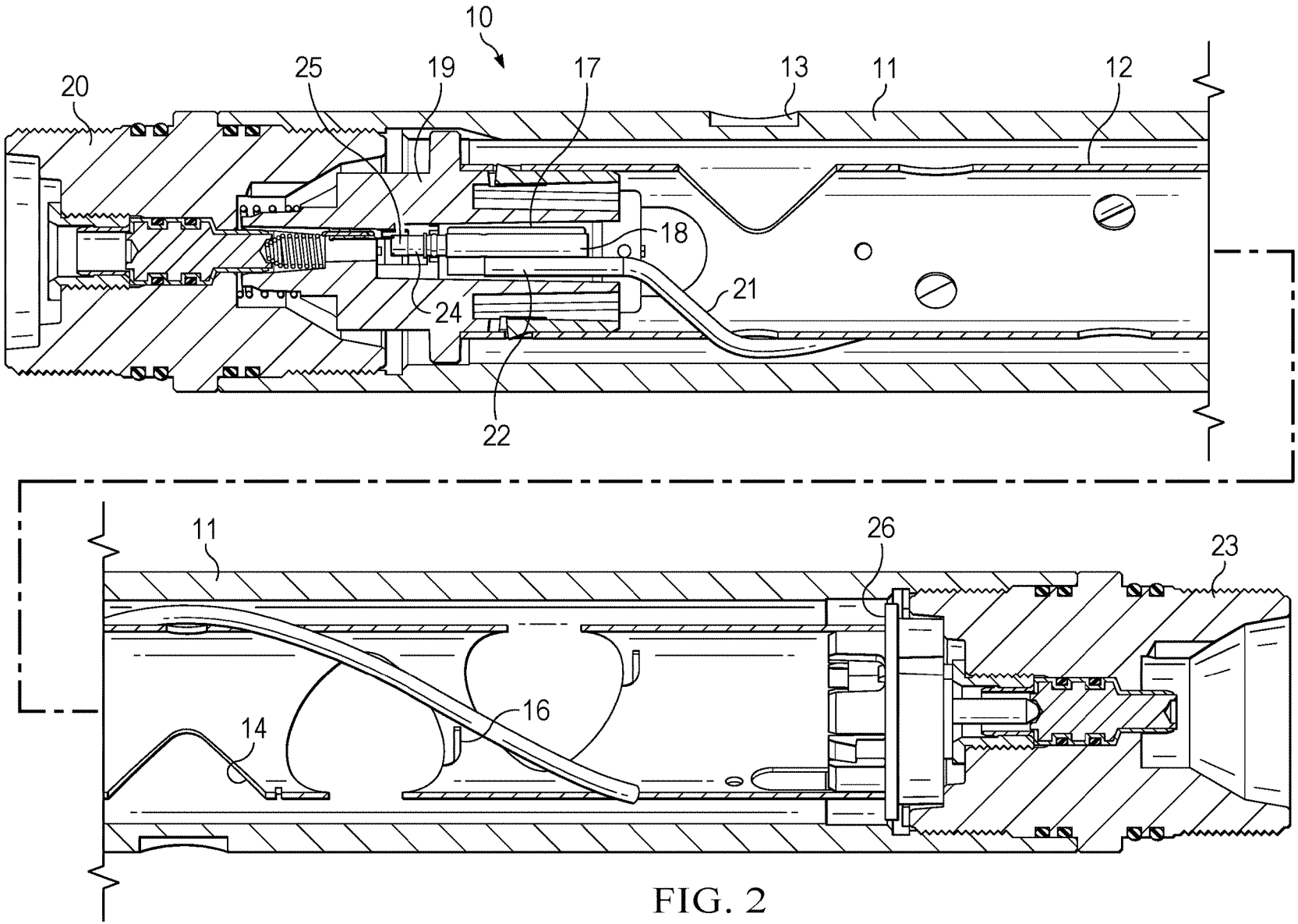
FIG. 2 shows a top cross-section view of an example embodiment of an assembled perforating gun with a self-arming device.

An example embodiment in FIG. 1 shows a perforating gun assembly 10 containing a perforating gun body 11, a top tandem sub 20 coupled to the top of the gun body 11 and fully installed, and a bottom tandem sub 23 coupled to the bottom of the gun body 11. Within the gun body there is a charge tube 12 suspended within the gun body 11 via a top end fitting 19 and a bottom end fitting 26 depicted in FIG. 2. Referring again to FIG. 1, the top end fitting 19 includes a detonator holder 17 for holding a detonator 18. The detonator 18 includes a connector 24 that connects to a connector coupled to the detonator holder 17. The top end fitting includes a slot for containing the end of the detonating cord 21, having a booster 22, in a horizontal position as depicted in FIG. 1. The detonator holder 17 hinges about hinge 29 such that when it is fully installed it is locked in the horizontal position, thus aligning the detonator 18 horizontally in a side-by-side explosive coupling configuration with the booster 22 of detonating cord 21. The detonator holder 17 has a ramp 27 and a tab 28. Installing the top end fitting 19 into the gun body 11 causes the open detonator holder 17 to engage with the inner surface of the gun body via ramp 27, rotating the detonator holder 17 about its hinge 29 until it is in the closed or horizontal position as depicted in FIG. 1, tab 28 secures the detonator holder 17 in the closed position when top end fitting 19 is fully installed in the gun body 11.

Figure 3:
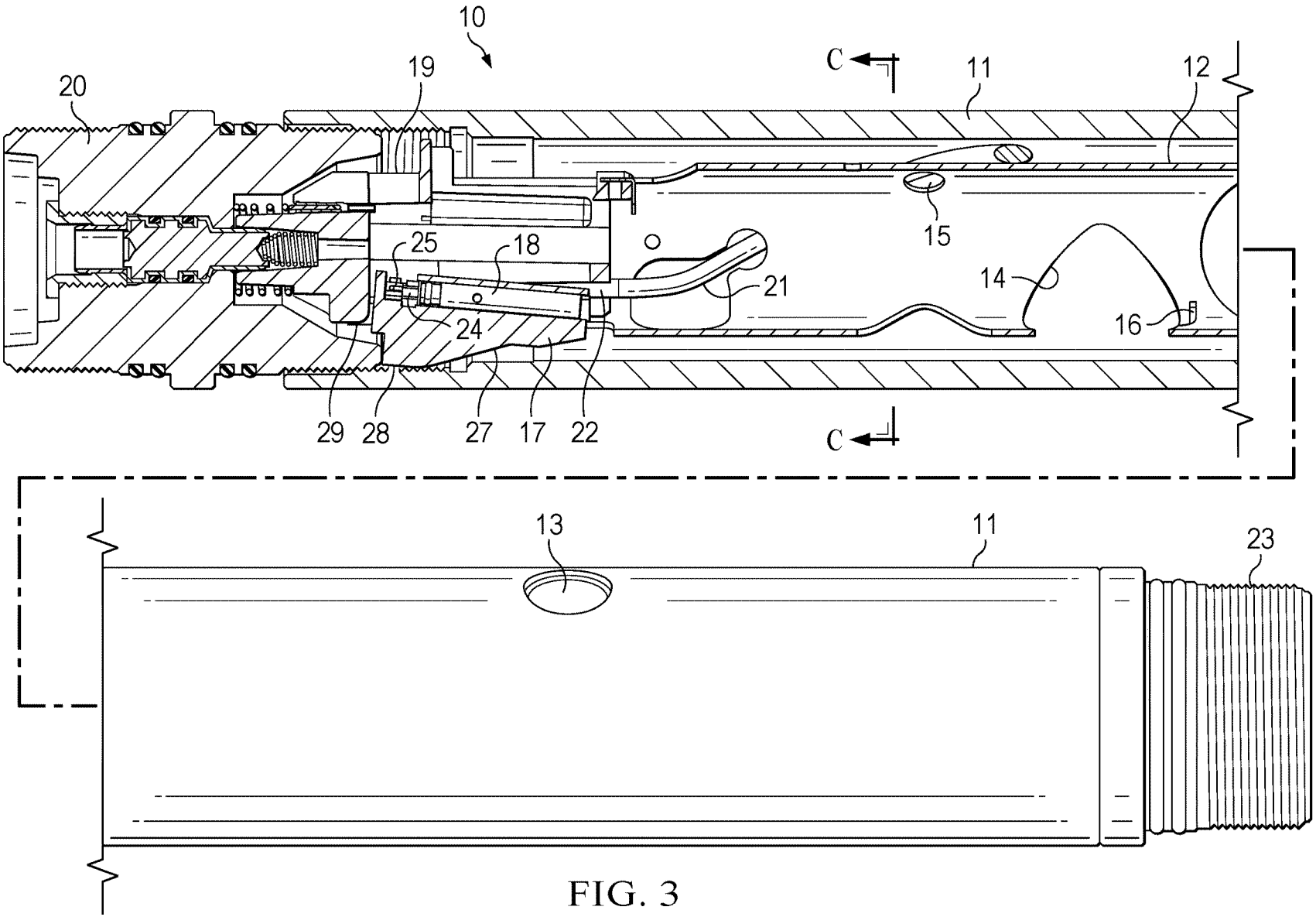
FIG. 3 shows a side cross-section view of an example embodiment of an unassembled perforating gun with a self-arming device.

An example embodiment in FIG. 3 shows a perforating gun assembly 10 with the detonator holder 17 open because the top tandem sub 20 is partially installed. The ramp 27 and a tab 28 are not past the threads and have not engaged with the inner surface of the gun body 11. Therefore, when the top tandem sub 20 is partially installed as depicted in FIG. 3 the detonator 18 is not aligned in a side-by-side configuration with the detonating cord 21.

Figure 4:
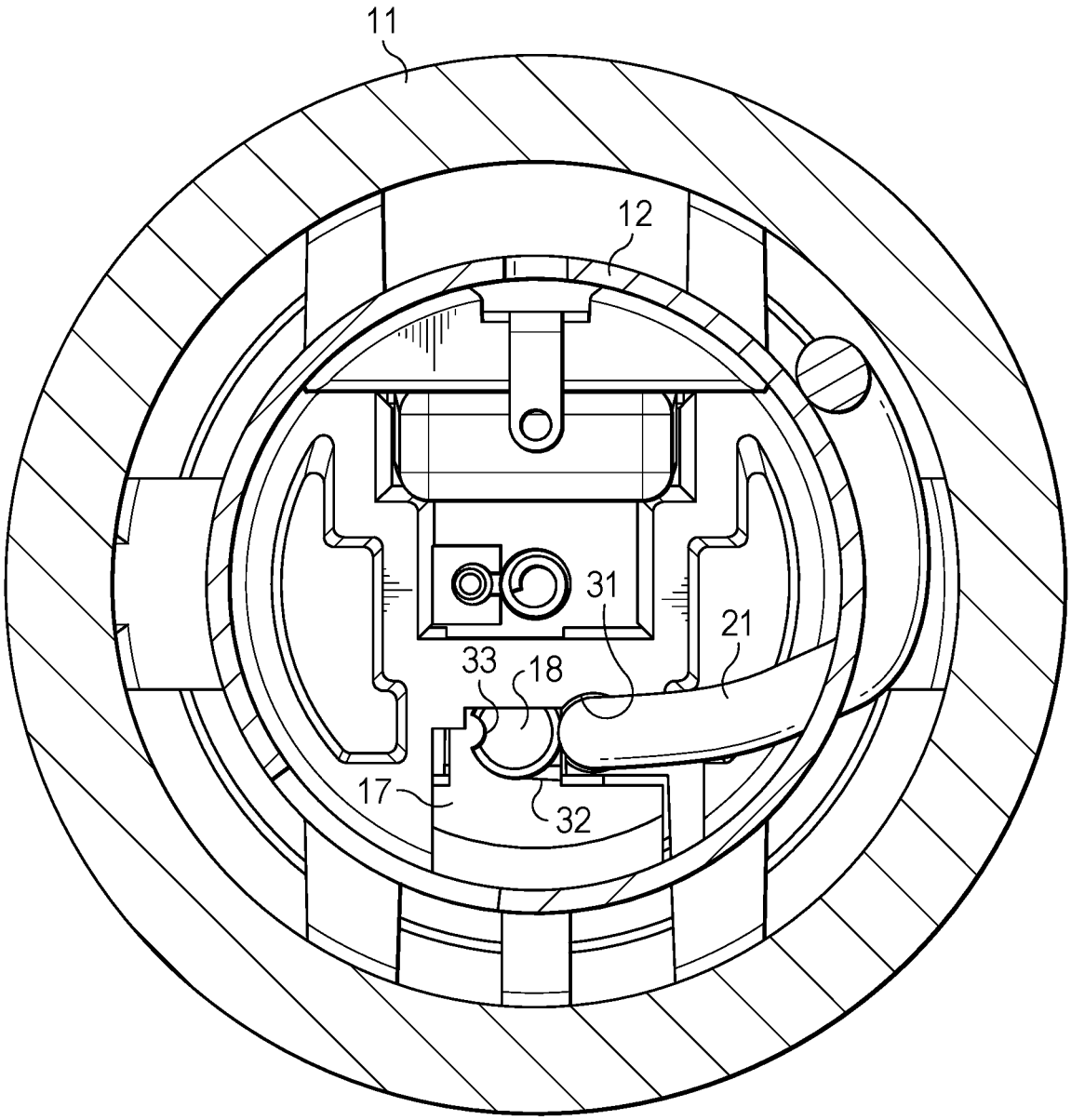
FIG. 4 shows a section view of the details of a self-arming device in the armed position.

An example embodiment in FIG. 4 shows a cross section indicated as B-B in FIG. 1. The cross section shows the charge tube 12 within the gun body 11. The detonator 18 is shown in its side-by-side configuration with the detonating cord 21. Tab 33 retains the detonator in place within the detonator slot 32 in the detonator holder 17.

Figure 5:
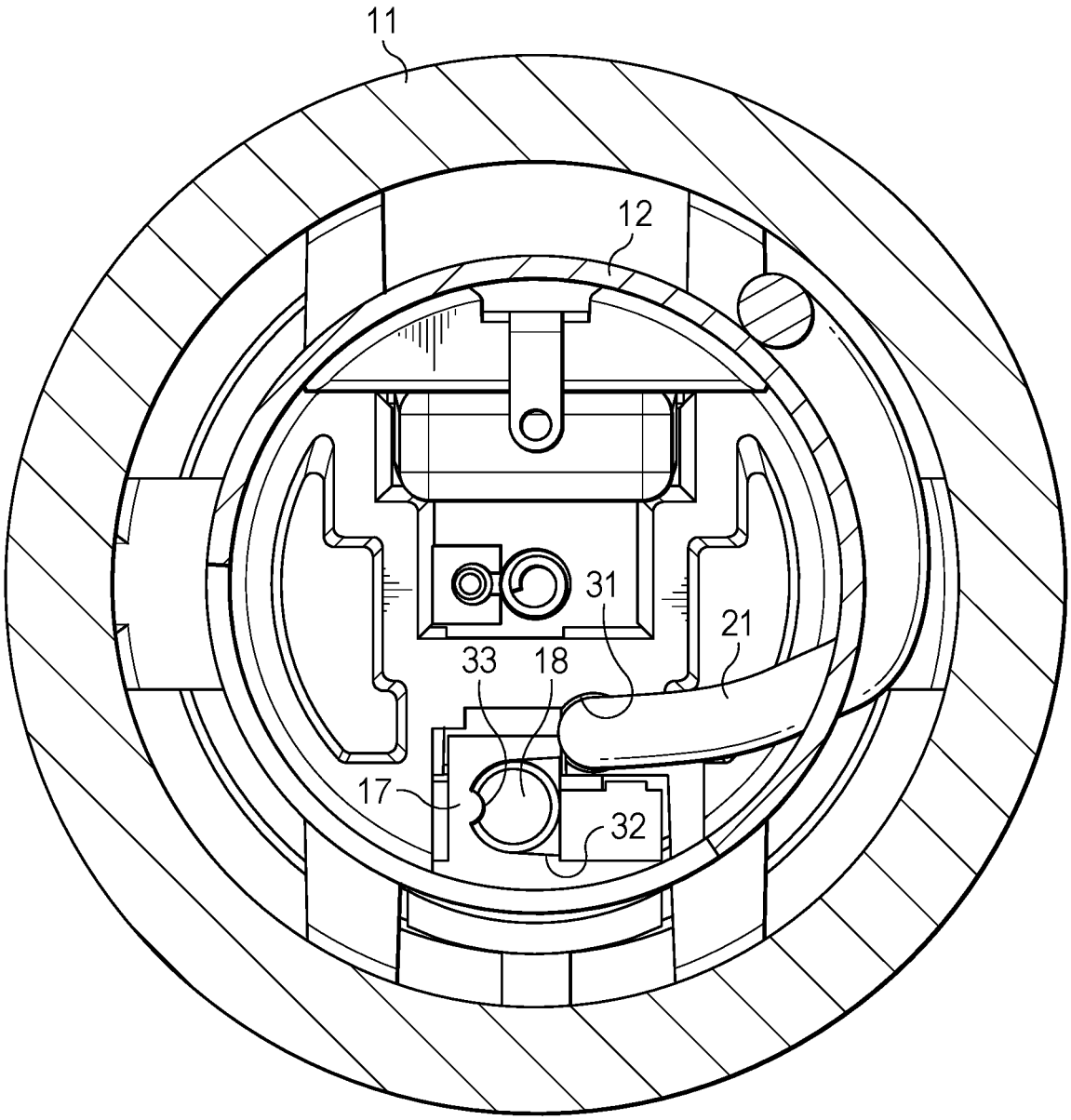
FIG. 5 shows a section view of the details of a self-arming device in the unarmed position.

An example embodiment in FIG. 5 shows a cross section indicated as C-C in FIG. 3. The cross section shows the charge tub 12 within the gun body 11. The detonator 18 is shown not aligned with the detonator cord 21. Tab 33 retains the detonator in place within the detonator slot 32 in the detonator holder 17. The detonator holder 17 defaults to an open position, as in unengaged, when the top tandem sub 20 is not completely installed into the gun body 11.

Figure 6:
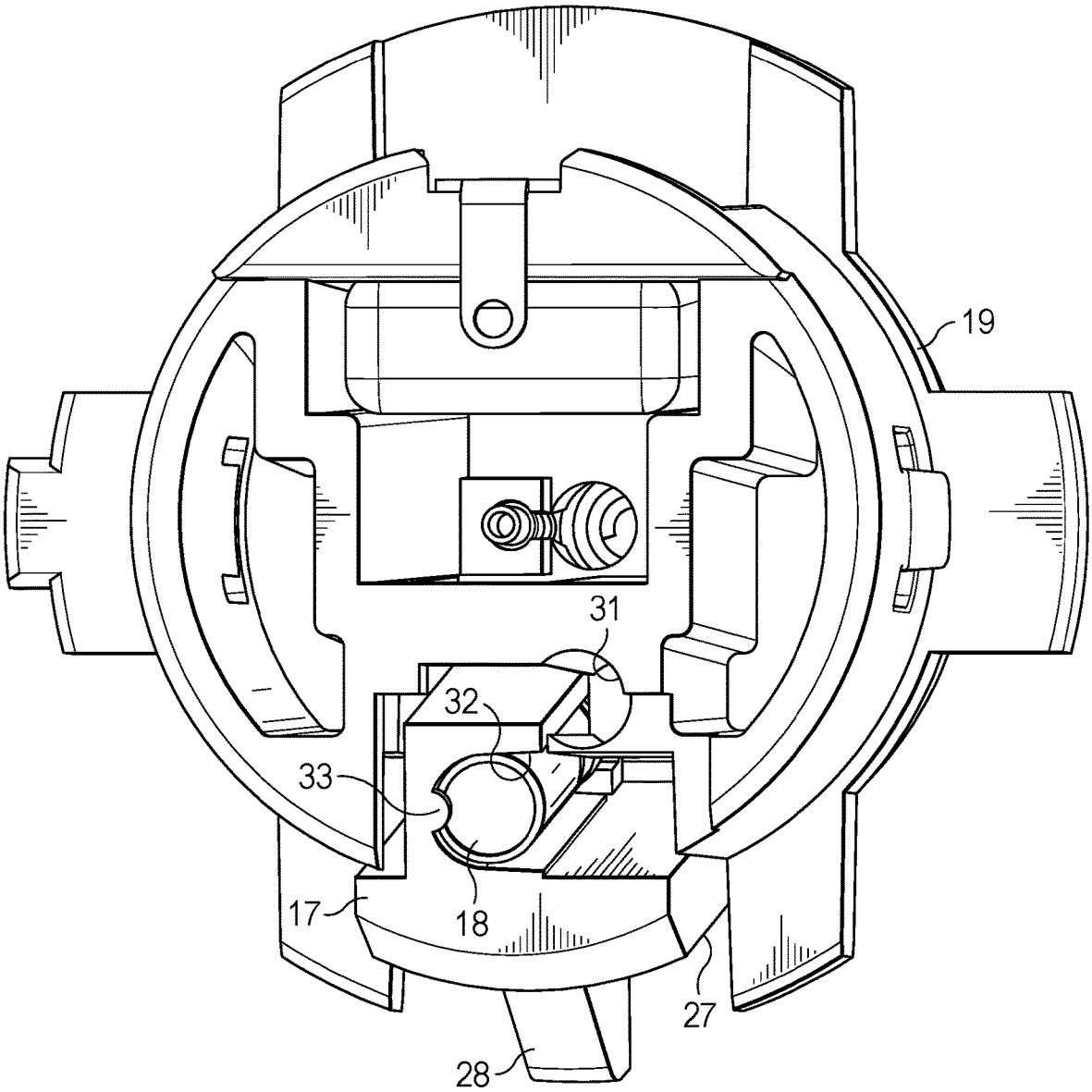
FIG. 6 shows a cut away three dimensional for of the details of a self-arming device in the unarmed position.

An example embodiment in FIG. 6 shows a three-dimensional view of the detonator holder 17 in its unarmed position. The detonator holder 17 contains the detonator 17 within the detonator slot 32 and held in place with the detonator tab 33. The ramp 27 and a tab 28 provide a means for orienting the detonator 17 into a side-by-side alignment with a detonating cord when the top end fitting 19 is fully installed into a perforating gun assembly 10.

Although the example embodiments have been described in terms of embodiments which are set forth in detail, it should be understood that this is by illustration only and that the example embodiments are not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the example embodiments are contemplated which may be made without departing from the spirit of the claimed example embodiments.

What is claimed is:

1. A perforating gun comprising:

an outer carrier;

a charge tube assembly that having a loading tube containing a plurality of shaped charges and a detonating cord coupled to said shaped charges;

a loading tube end fitting coupled to a first end of the loading tube containing a detonator housed in a hinged detonator holder configured to move the detonator between a ballistically unarmed position to a ballistically armed position, wherein the initial state of the perforating gun prior to connecting a second perforating gun, the movable detonator holder of the first perforating gun is positioned inside the carrier such that the detonator is not directly positioned end to end nor side by side with the detonating cord in the loading tube.

2. The perforating gun from claim 1 wherein the ballistically unarmed detonator is the detonator not directly positioned end to end nor side by side with the detonating cord in the loading tube.

3. The perforating gun from claim 1 wherein ballistically armed detonator the detonator directly positioned end to end or side by side with the detonating cord in the loading tube.

4. The perforating gun from claim 1 where the detonator holder is a hinged door with a wedge shaped outer profile configured to shut as the outer profile makes contact with an inner surface of the carrier as the charge tube assembly moves further into the carrier.

5. The perforating gun from claim 1, wherein the charge tube assembly is moved as a result of the perforating gun being coupled to a second perforating gun.

6. The perforating gun from claim 1 wherein the detonator holder is a hinged door with a curved shaped outer profile configured to shut as the outer profile makes contact with the inner surface of the carrier.

7. The perforating gun from claim 1 wherein the detonator holder is a sliding door configured to slide as the outer profile makes contact with the inner surface of the carrier.

8. The perforating gun from claim 1, wherein the second perforating gun is screwed onto the first perforating gun, the entire charge tube assembly moves, closing the detonator holder further into the carrier such that the detonating holder closes in on the detonating cord until the detonator is adjacent to the detonating cord to connect the detonator to detonating cord ballistic train.

9. The perforating gun from claim 1, wherein the second perforating gun is screwed onto the first perforating gun, the detonator holder moves in relation to the loading tube inside the carrier such that the detonating holder closes in on the detonating cord until the detonator is adjacent to the detonating cord to connect the detonator to detonating cord ballistic train.

10. The perforating gun from claim 1, wherein the second perforating gun is screwed onto the first perforating gun, the detonator holder slides a further distance than does the entire charge tube assembly and positions the detonator adjacent to the detonating cord to connect the detonator to detonating cord ballistic train.

11. A method for perforating a wellbore comprising:

coupling a loading tube, a plurality of shaped charges, and a detonating cord into a first perforating gun assembly;

inserting a detonator into a movable detonator holder in a loading tube end fitting;

inserting the loading tube end fitting into a first perforating gun; and moving the detonator between a ballistically unarmed position to a ballistically armed position, wherein the initial state of the first perforating gun assembly prior to connecting the second perforating gun, the movable detonator holder of the first perforating gun is positioned inside the carrier such that the detonator is not directly positioned end to end nor side by side with the detonating cord in the loading tube.

12. The method for perforating a wellbore from claim 11 wherein the ballistically unarmed detonator is the detonator not directly positioned end to end nor side by side with the detonating cord in the loading tube.

13. The method for perforating a wellbore from claim 11 wherein ballistically armed detonator is the detonator directly positioned end to end or side by side with the detonating cord in the loading tube.

14. The method for perforating a wellbore from claim 11, further comprising moving the charge tube assembly by coupling a second perforating gun into the first perforating gun.

15. The method for perforating a wellbore from claim 11 further comprising sliding the detonator holder as the outer profile makes contact with the inner surface of the carrier.

16. The method for perforating a wellbore from 11, wherein the second perforating gun is screwed onto the first perforating gun, the entire charge tube assembly moves, closing the detonator holder further into the carrier such that the detonating holder closes in on the detonating cord until the detonator is adjacent to the detonating cord to connect the detonator to detonating cord ballistic train.

17. The method for perforating a wellbore from claim 11, wherein the second perforating gun is screwed onto the first perforating gun, the detonator holder moves in relation to the loading tube inside the carrier such that the detonating holder closes in on the detonating cord until the detonator is adjacent to the detonating cord to connect the detonator to detonating cord ballistic train.

18. The method for perforating a wellbore from claim 11, wherein the second perforating gun is screwed onto the first perforating gun, the detonator holder slides a further distance than does the entire charge tube assembly and positions the detonator adjacent to the detonating cord to connect the detonator to detonating cord ballistic train.

* * * * *